US007791545B2

(12) United States Patent
Lin et al.

(10) Patent No.: US 7,791,545 B2
(45) Date of Patent: Sep. 7, 2010

(54) MULTIBAND ANTENNA

(75) Inventors: Sheng-Chih Lin, Hsin-Tien (TW); Tsung-Wen Chiu, Hsin-Tien (TW); Fu-Ren Hsiao, Hsin-Tien (TW)

(73) Assignee: Advanced Connectek, Inc., Taipei (TW)

( * ) Notice: Subject to any disclaimer, the term of this patent is extended or adjusted under 35 U.S.C. 154(b) by 0 days.

(21) Appl. No.: 11/943,799

(22) Filed: Nov. 21, 2007

(65) Prior Publication Data

US 2008/0122702 A1 May 29, 2008

(30) Foreign Application Priority Data

Nov. 24, 2006 (TW) ..... 95143543 A

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846, 906
See application file for complete search history.

(56) References Cited

U.S. PATENT DOCUMENTS 5,764,190 A 6/1998 Murch et al.
6,992,627 B1 * 1/2006 Honda et al. ..... 343/700 MS
7,050,010 B2 * 5/2006 Wang et al. ..... 343/702
7,212,161 B2 * 5/2007 Chen et al ..... 343/700 MS
7,236,132 B1 6/2007 Lin et al.
7,535,422 B2 * 5/2009 Liu et al. ..... 343/702
2004/0113848 A1 * 6/2004 Gaucher et al. ..... 343/702

* cited by examiner

*Primary Examiner*—James H. Cho
*Assistant Examiner*—Christopher Lo
(74) *Attorney, Agent, or Firm*—Schmeiser, Olsen & Watts LLP

(57) ABSTRACT

A multiband antenna with the broadband function has a radiator, a feed cable, a first extension conductor, and a second extension conductor. The radiator has a microwave substrate, a coupling conductor, a first conductor, a second conductor, a third conductor, and a connecting conductor. The coupling conductor is connected with a positive signal wire of the feed cable. The third conductor is connected with a negative signal of the feed cable for transmitting electrical signals. The radiator generates the multiband mode of the antenna. By connecting the first extension conductor and the second extension conductor with the radiator, the surface current distribution and impedance variation of the antenna can be effectively adjusted to achieve the broadband effect.

3 Claims, 5 Drawing Sheets

MULTIBAND ANTENNA

BACKGROUND OF THE INVENTION

1. Field of the Invention

The invention relates to a multiband antenna and, in particular, to a multiband antenna capable of being operated in broadband range.

2. Description of Related Art

Wireless communication systems have a lot of progress in recent years, presenting great potential and business opportunity. Their techniques and bands are not completely the same. Each of these systems plays an important role in a distinct area and market. However, this phenomenon causes troubles and inconvenience to both system suppliers and consumers. One disadvantage is that different communication systems use different frequencies, such as GSM900, PCS1900, and Universal Mobile Telecommunications System (UMTS).

For the convenience of users, manufacturers have devoted a lot of manpower to develop products integrated with multiple band functions. However, the first difficulty that has to be overcome is the antenna. The antenna can be regarded as the beginning and end of wireless communications. Its performance directly affects the communication quality. As modern electronic devices are light and compact, the antennas also become smaller and hidden inside mobile communication devices. Since the planar inverted-F antenna (PIFA) has a length of ¼ wavelength, the sizes of antennas can be greatly reduced. Therefore, it is widely used in the design of built-in small antennas.

The PIFA that works in a single frequency can be found in, for example, U.S. Pat. No. 5,764,190. To enable multiband usage of the PIFA, the radiation metal sheet is cut with a V-shaped notch or U-shaped notch.

Another multiband antenna is shown in FIG. 1. The antenna includes a first radiation part A, a second radiation part B, and a ground part C. The first radiation part A and the second radiation part B are extended from two opposite side edges of the same end of the ground part C. The first radiation part A includes a first conducting sheet A1 parallel to the ground part C and a first connecting part A2 that is connected between the first conducting sheet A1 and the ground part C. The second radiation part B includes a second conducting sheet B1 parallel to the ground part C and a second connecting part B2 that is connected between the second conducting sheet B1 and the ground part C. The first conducting sheet A1 and the second conducting sheet B1 are extended from the first connecting part A2 and the second connecting part B2, respectively, toward the same direction.

Although the above-mentioned antenna can achieve the multiband operations, it has the following disadvantages. The distance between the first conducting sheet A1 and the second conducting sheet B2 is too close. Therefore, the bandwidths in low and high frequencies are insufficient. The antenna thus cannot effectively cover multiple system bands. During the real production process, the small distance also results in large errors and a lower yield. Moreover, as a conventional PIFA, a feed cable and a feed point on the antenna are close to the first connecting part A2. There is an upper limit in the antenna bandwidth, unable to achieve the broadband effect.

To solve the above-mentioned problems, the invention provides a novel means for a multiband antenna with the broadband function. The invention uses a radiator as the primary antenna radiation structure. The radiator has several sections of conductors and connecting conductors, thereby producing multiple resonant modes and multiband operations. Through coupling, electrical signals are fed into the antenna radiator to improve the bandwidth restriction of the conventional PIFA. At the same time, using two extension conductors, the surface current distribution and impedance variation of the antenna can be effectively controlled, so that the antenna has both the broadband feature and high radiation efficiency. In addition to the novel structure, the antenna also achieves the multiband operations, greatly enhancing the bandwidth and efficiency thereof. The disclosed antenna is thus compatible with multiple system bands and has a lot of industrial values.

SUMMARY OF THE INVENTION

An objective of the invention is to provide a multiband antenna with the broadband operation ability. Using an coupling feed antenna radiator and two extension conductors, the multiband antenna can be operated in a high-frequency broadband range of 1575~2500 MHz. This satisfies the requirements of GPS, DCS, PCS, UMTS, and Wi-Fi systems.

Another objective of the invention is to provide a multiband antenna with the broadband operation ability. Using the antenna radiator and two extension conductors, the multiband antenna can be operated in a low-frequency broadband range of 824~960 MHz. This satisfies the requirements of AMPS and GSM systems.

The invention utilizes the following technical features to achieve the above-mentioned objectives. The multiband antenna includes a radiator, a feed cable, a first extension conductor, and a second extension conductor. The radiator is the primary radiation structure of the invention for multiple band operations. The radiator has a microwave substrate, a coupling conductor, a first conductor, a second conductor, a third conductor and a connecting conductor.

The coupling conductor is disposed on the microwave conductor and connected with the positive signal wire of the feed cable. The first conductor is also disposed on the microwave substrate and is adjacent to the coupling conductor to form a coupling structure. The distance between the first conductor and the coupling conductor is less than 3 mm, thereby feeding the electrical signal into the antenna. The second conductor is disposed on the microwave substrate, with one end connected with the first conductor and the other end extending away from first conductor. The third conductor is disposed on the microwave substrate and connected with the negative signal wire of the feed cable. The third conductor extends in parallel with the first conductor. The connecting conductor is disposed on the microwave substrate for electrically connecting the first, second, and third conductors. The first conductor, the third conductor, and the connecting conductor of the radiator form a primary resonant structure for generating the low frequency and the second highest frequency modes of the antenna. The second conductor and the connecting conductor form a parasitic structure for generating the highest frequency mode. The radiator thus has several resonant modes for multiband operations. Furthermore, the electrical signals are fed into the radiator via the coupling structure formed between the coupling conductor and the first conductor. Therefore, by appropriately adjusting the area and the clearance of the coupling conductor, the energy can be uniformly fed into the antenna, achieving good impedance matching.

Besides, the first extension conductor is connected to the first conductor and the second conductor. The second extension conductor is connected with the third conductor. By varying the areas of the two extension conductors, the surface current distribution and impedance variation of each section of conductor can be effectively adjusted, so that the surface current distribution is more uniform and the impedance variation is smoother. This helps achieving the broadband operation and promoting the antenna radiation efficiency. Therefore the invention uses the simple structure of a radiator to achieve multiband operations. The use of extension conductors renders the multiband antenna a larger operation bandwidth. This satisfies the requirements of multiple system bands and has great industrial values.

DETAILED DESCRIPTION OF THE PREFERRED EMBODIMENT

Figure 1:
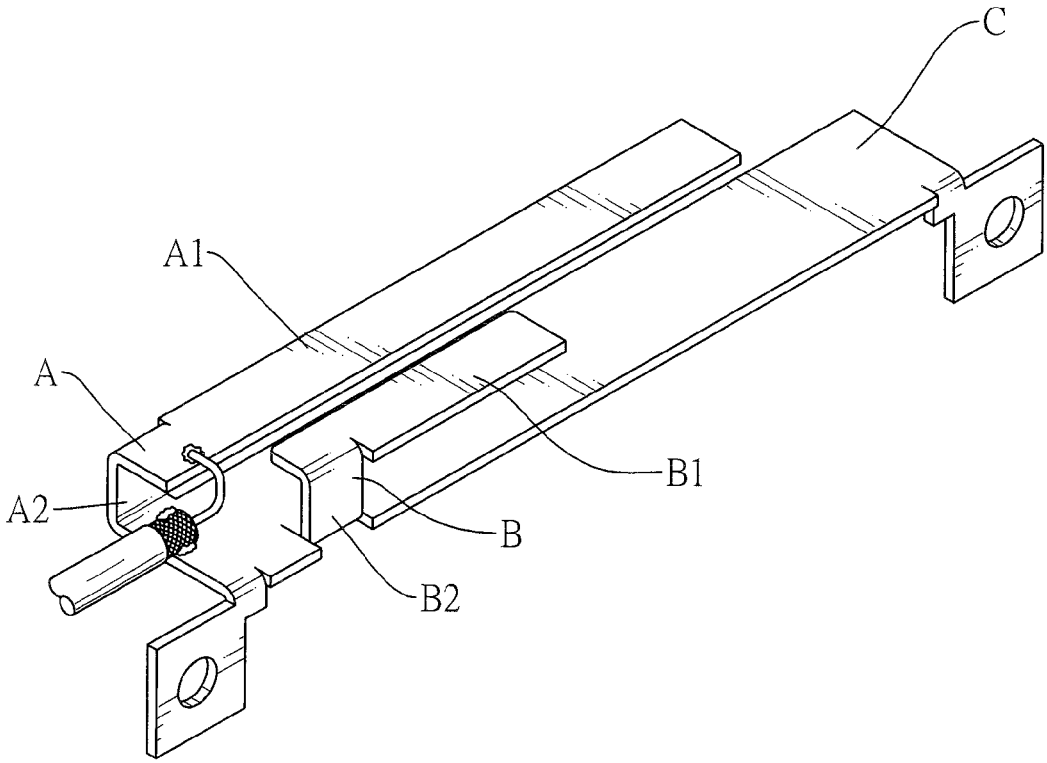
FIG.1 PRIOR ART
FIG. 1 is a perspective view of a conventional multiband antenna.
Figure 2:
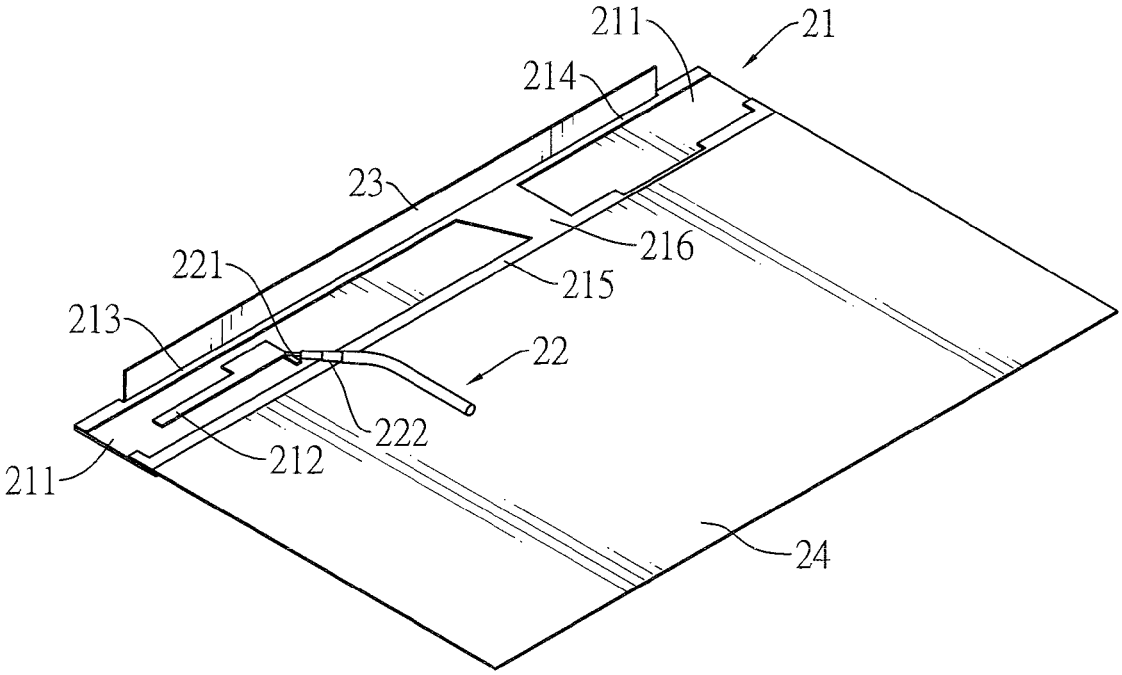
FIG. 2 is a perspective view of an antenna in accordance with a first embodiment of the present invention.

With reference to FIG. 2, a first embodiment of a multiband antenna comprises a radiator 21, a feed cable 22, a first extension conductor 23, and a second extension conductor 24.

The radiator 21 includes a microwave substrate 211, a coupling conductor 212, a first conductor 213, a second conductor 214, a third conductor 215 and a connecting conductor 216. The coupling conductor 212 is disposed on the microwave substrate 211. The first conductor 213 is disposed on the microwave conductor 211 and is adjacent to the coupling conductor 212 to form a coupling structure that has a coupling clearance as small as 3 mm, thereby feeding electrical signals into the antenna. The second conductor 214 is disposed on the microwave substrate 211, with one end connected with the first conductor 213 and the other end extending away from the first conductor 213. The third conductor 215 is disposed on the microwave substrate 211 in parallel to the first conductor 213. The connecting conductor 216 is disposed on the microwave substrate 211, with one end connected with the first conductor 213 and the second conductor 214 and the other end connected with the third conductor 215.

The feed cable 22 transmits high-frequency signals and has a positive signal wire 221 and a negative signal wire 222. The positive signal wire 221 is connected with the coupling conductor 212 and the negative signal wire 222 is connected with the third conductor 215.

The first extension conductor 23 is electrically connected with the first conductor 213 and the second conductor 214. The area of the first extension conductor 23 is larger than that of the first conductor 213 and the second conductor 214.

The second extension conductor 24 is electrically connected with the third conductor 215. The area of the second extension conductor 24 is larger than that of the third conductor 215. In particular, the first conductor 213, the third conductor 215, and the connecting conductor 216 of the radiator 21 form a primary resonant structure for generating the low frequency and second highest frequency modes. The second conductor 214 and the connecting conductor 216 form a parasitic structure for generating the highest frequency mode of the antenna. Thus, the radiator 21 has several resonant modes for multiband operations. The electrical signals are fed into the radiator 21 via the coupling structure of the coupling conductor 212 and the first conductor 213. Therefore, by appropriately adjusting the area of the coupling conductor 212 and the coupling clearance with the first conductor 213, the energy can be uniformly fed into the antenna with good impedance matching. Besides, by adjusting the areas of the two extension conductors 23, 24, the surface current distribution and impedance variation of each section of conductor can be significantly adjusted, rendering a more uniform surface current distribution and smoother impedance variation. This helps forming the broadband effect and promoting the antenna radiation efficiency.

Figure 3:
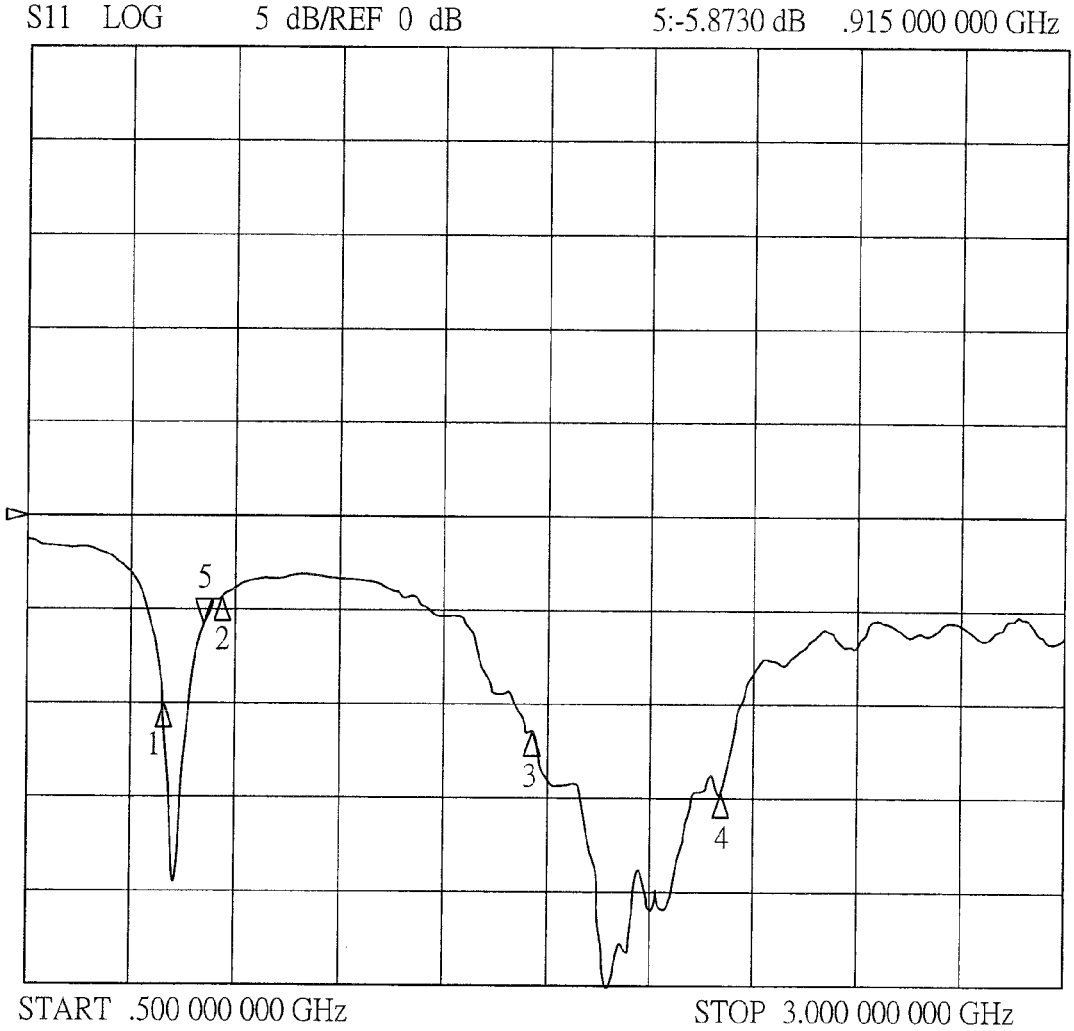
FIG. 3 shows the return loss of the antenna shown in FIG. 2.

With reference to FIG. 3, the low-frequency mode 31 of the antenna covers those required by the AMPS (824~894 MHz) and GSM (880~960 MHz) systems. The second highest frequency mode 32 and the highest frequency mode 33 combines to form a broadband mode, covering those required by the GPS (1575 MHz), DCS (1710~1880 MHz), PCS (1850~1990 MHz), UMTS (1920~2170 MHz), and Wi-Fi (2400~2500 MHz) systems. The antenna achieves multiband operations with good performance.

Figure 4:
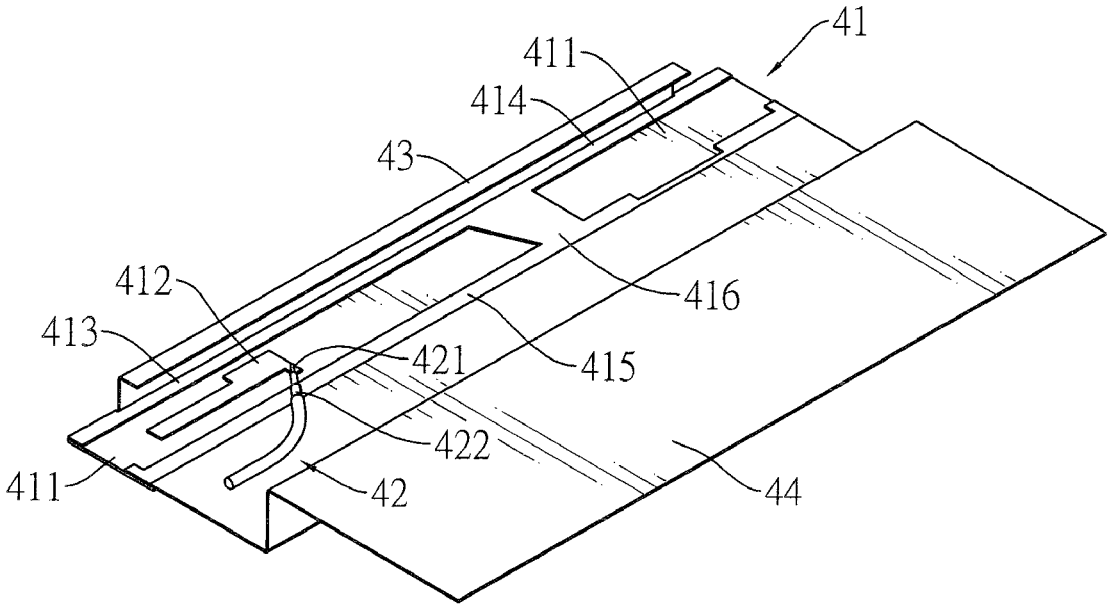
FIG. 4 is a perspective view of the antenna in accordance with a second embodiment of the present invention.

With reference to FIG. 4, the second embodiment of the multiband antenna comprises a radiator 41, a feed cable 42, a first extension conductor 43, and a second extension conductor 44.

The radiator 41 includes a microwave substrate 411, a coupling conductor 412, a first conductor 413, a second conductor 414, a third conductor and a connecting conductor 416.

The coupling conductor 412 is disposed on the microwave substrate 411. The first conductor 413 is disposed on the microwave conductor 411 and is adjacent to the coupling conductor 412 to form a coupling structure that has a coupling clearance less than 3 mm, thereby feeding electrical signals into the antenna. The second conductor 414 is disposed on the microwave substrate 411, with one end connected with the first conductor 413 and the other end extending away from the first conductor 413. The third conductor 415 is disposed on the microwave substrate 411 and extends in parallel with the first conductor 413. The connecting conductor 416 is disposed on the microwave substrate 411, with one end connected to the first conductor 413 and the second conductor 414 and the other end connected to the third conductor 415.

The feed cable 42 transmits high-frequency signals and has a positive signal wire 421 connected with the coupling conductor 412 and a negative signal wire 422 connected with the third conductor 415.

The first extension conductor 43 has is bent to form a top protruding edge and is electrically connected with the first conductor 413 and the second conductor 414. The are of the first extension conductor 43 is larger than those of the first conductor 413 and the second conductor 414. The second extension conductor 44 is flexible and is electrically connected with the third conductor 415. In particular, the first conductor 413, the third conductor 415, and the connecting conductor 416 of the radiator 41 form a primary resonant structure for generating the low frequency and second highest frequency modes. The second conductor 414 and the connecting conductor 416 form a parasitic structure for generating the highest frequency mode of the antenna. Thus, the radiator 41 has several resonant modes for multiband operations. The electrical signals are fed into the radiator 41 via the coupling structure of the coupling conductor 412 and the first conductor 413. Therefore, by appropriately adjusting the area of the coupling conductor 412 and the coupling clearance with the first conductor 413, the energy can be uniformly fed into the antenna with good impedance matching. Besides, by adjusting the areas of the two extension conductors 43, 44, the surface current distribution and impedance variation of each section of conductor can be significantly adjusted, rendering a more uniform surface current distribution and smoother impedance variation. This helps forming the broadband operation and promoting the antenna radiation efficiency.

Figure 5:
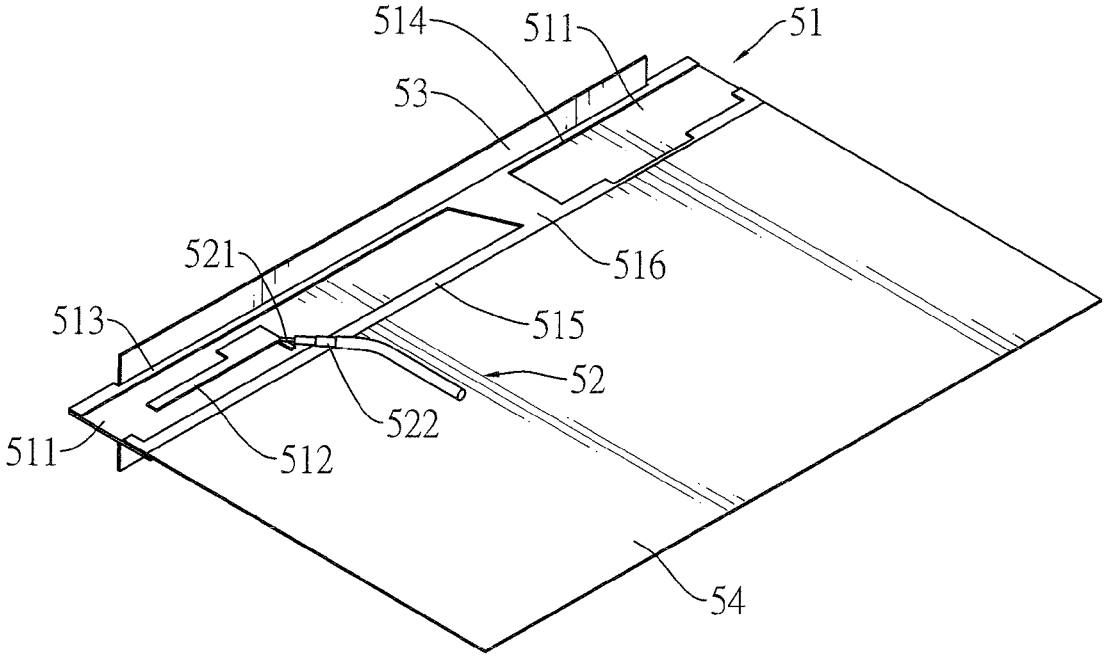
FIG. 5 is a perspective view of the antenna in accordance with a third embodiment of the present invention.

With reference to FIG. 5, the third embodiment of the multiband antenna comprises a radiator 51, a feed cable 52, a first extension conductor 53, and a second extension conductor 54.

The radiator 51 includes a microwave substrate 511, a coupling conductor 512, a first conductor 513, a second conductor 514, a third conductor 515 and a connecting conductor 516.

The coupling conductor 512 is disposed on the microwave substrate 511. The first conductor 513 is disposed on the microwave conductor 511 and is adjacent to the coupling conductor 512 to form a coupling structure that has a coupling clearance less 3 mm, thereby feeding electrical signals into the antenna. The second conductor 514 is disposed on the microwave substrate 511, with one end connected with the first conductor 513 and the other end extending away from the first conductor 513. The third conductor 515 is disposed on the surface of the microwave substrate 511 and extends in parallel to the first conductor 513. The connecting conductor 516 is disposed on the microwave substrate 511, with one end connected to the first conductor 513 and the second conductor 514 and the other end connected to the third conductor 515.

The feed cable 52 transmits high-frequency signals and has a positive signal wire 521 connected with the coupling conductor 512 and a negative signal wire 522 connected with the third conductor 515.

The first extension conductor 53 penetrates through the microwave substrate 511 and is electrically connected with the first conductor 513 and the second conductor 514. The first extension conductor 53 is larger than the first conductor 513 and the second conductor 514 in area.

The second extension conductor 54 is electrically connected with the third conductor 515. The second extension conductor 54 is greater than the third conductor 515 in area. In particular, the first conductor 513, the third conductor 515, and the connecting conductor 516 of the radiator 51 form a primary resonant structure for generating the low frequency and second highest frequency modes. The second conductor 514 and the connecting conductor 516 form a parasitic structure for generating the highest frequency mode of the antenna. Thus, the radiator has several resonant modes for multiband operations. The electrical signals are fed into the radiator 51 via the coupling structure of the coupling conductor 512 and the first conductor 513. Therefore, by appropriately adjusting the area of the coupling conductor 512 and the coupling clearance with the first conductor 513, the energy can be uniformly fed into the antenna with good impedance matching. Besides, by adjusting the areas of the two extension conductors 53, 54, the surface current distribution and impedance variation of each section of conductor can be significantly adjusted, rendering a more uniform surface current distribution and smoother impedance variation. This helps forming the broadband effect and promoting the antenna radiation efficiency.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multiband antenna comprising:

a radiator, including:

a microwave substrate, a coupling conductor disposed on the microwave substrate, a first conductor disposed on the microwave substrate and being separated from the coupling conductor by a clearance to electrically isolate the first conductor from the coupling conductor, a second conductor disposed on the microwave substrate with one end connected to the first conductor, and the other end extending away from the first conductor, a third conductor disposed on the microwave substrate and extending in parallel with the first conductor and toward a peripheral side of the microwave substrate, and a connecting conductor disposed on the microwave substrate and having a first end connected to a junction where the first conductor and the second conductor are connected to each other, and a second end connected to the third connector, a feed cable comprising a positive signal wire connected with the coupling conductor and a negative signal wire connected with the third conductor;

a first extension conductor electrically connected with the first conductor and the second conductor; and a second extension conductor electrically connected with the third conductor;

wherein the clearance between the coupling conductor and the first conductor is less than 3 mm.

2. The multiband antenna of claim 1, wherein the area of the first extension conductor is larger than those of the first conductor and the second conductor.

3. The multiband antenna of claim 1, wherein the area of the second extension conductor is larger than that of the third conductor.

* * * * *